United States Patent [19]

Yabunaka

[11] Patent Number: 4,736,112

[45] Date of Patent: Apr. 5, 1988

[54] STARTER FOR AN INTERNAL COMBUSTION ENGINE

[75] Inventor: Kiyoshi Yabunaka, Hyogo, Japan

[73] Assignee: Mitsubishi Denki Kabushiki Kaisha, Tokyo, Japan

[21] Appl. No.: 734,949

[22] PCT Filed: Sep. 11, 1984

[86] PCT No.: PCT/JP84/00437

§ 371 Date: May 10, 1985

§ 102(e) Date: May 10, 1985

[87] PCT Pub. No.: WO85/01322

PCT Pub. Date: Mar. 28, 1985

[30] Foreign Application Priority Data

Sep. 13, 1983 [JP] Japan ..... 58-169704

[51] Int. Cl.[4] ..... F02N 11/08

[52] U.S. Cl. ..... 290/38 R; 123/179 P

[58] Field of Search ..... 290/DIG. 1, DIG. 3, 290/38 R, 38 B, 38 C, 38 D, 38 E; 123/179 P; 74/7

[56] References Cited

U.S. PATENT DOCUMENTS

| | | | |
|---|---|---|---|
| 1,111,885 | 9/1914 | Deutsch | 290/DIG. 1 |
| 1,396,518 | 11/1921 | McGrath | 290/38 R |
| 1,397,690 | 11/1921 | Lawrence | 290/38 R |
| 1,700,750 | 2/1929 | Vastano | 290/38 R |
| 1,768,083 | 6/1930 | Lansing | 290/38 B |
| 2,151,196 | 3/1939 | FitzGerald | 123/179 P |
| 4,415,812 | 11/1983 | Griffith et al. | 290/38 C X |
| 4,490,620 | 12/1984 | Hansen | 290/38 C X |

FOREIGN PATENT DOCUMENTS

| | | | |
|---|---|---|---|
| 144848 | 3/1936 | Austria | 74/7 |

*Primary Examiner*—William M. Shoop, Jr.
*Assistant Examiner*—W. E. Duncanson, Jr.
*Attorney, Agent, or Firm*—Sughrue, Mion, Zinn, Macpeak & Seas

[57] ABSTRACT

An internal combustion engine starter having a high starting performance has a first cranking mechanism including a self-starting motor 13 and a second cranking mechanism including a kick lever 18. The second cranking mechanism causes a crankshaft 1 to rotate mechanically during the beginning of its rotation which requires a high torque, and the first cranking mechanism places it in continuous rotation.

4 Claims, 4 Drawing Sheets

STARTER FOR AN INTERNAL COMBUSTION ENGINE

TECHNICAL FIELD

This invention relates to a starter for the internal combustion engine of, for example, a two-wheeled motor vehicle.

BACKGROUND ART

A starter for the internal combustion engine of a two-wheeled motor vehicle is shown in FIG. 1 to illustrate a conventionally known internal combustion engine starter of the type to which this invention pertains. The engine has a crankshaft 1 to which a sprocket 2 is secured. An intermediate shaft 3 lies in parallel to the crankshaft 1 and is rotatably supported by a bearing 4 on a stationary member not shown. A sprocket 5 is connected to the intermediate shaft 3 by a rotational variation buffering mechanism not shown. The sprocket 5 is connected to the sprocket 2 by a chain 6.

An overrunning clutch 7 has an outer member 7*a* to which the sprocket 5 is secured, and an inner member 7*b* fitted about the intermediate shaft 3. A sleeve 8 is disposed between the shaft 3 and the inner member 7*b* which are rotatable relative to each other. A spur gear 7*c* is formed on the inner member 7*b*. A spur gear 9 is secured to the intermediate shaft 3. A large gear 10 meshes with the spur gear 9 and is connected to a speed change gear not shown by a clutch not shown. An intermediate gear 11 is secured to a rotary shaft 12 and meshes with the spur gear 7*c*. A self-starting motor 13, which is driven by a battery 15 upon closure of a self-starting switch 14, has an output shaft 13*a* on which a pinion 16 meshing with the intermediate gear 11 is secured. A lever shaft 17 has at one end a clutch portion 17*a* which engages it unidirectionally with the rotary shaft 12. A kick lever 18 is connected to the other end of the lever shaft 17. The sprockets 2 and 5, chain 6, overrunning clutch 7, intermediate gear 11, rotary shaft 12, pinion 16, self-starting motor 13, self-starting switch 14 and battery 15 form a first cranking mechanism. The sprockets 2 and 5, chain 6, overrunning clutch 7, intermediate gear 11, rotary shaft 12, lever shaft 17 and kick lever 18 form a second cranking mechanism which is manually operable.

The manual cranking mechanism makes it possible to start the engine mechanically as will hereinafter be described. The kick lever 18 is actuated to rotate the lever shaft 17 and its rotation is transmitted to the crankshaft 1 through the rotary shaft 12, intermediate gear 11, overrunning clutch 7, sprocket 5, chain 6 and sprocket 2, whereby the engine is started. The rotation of the engine is transmitted to the speed change gear through the sprocket 2, chain 6, sprocket 5, rotational variation buffering mechanism, intermediate shaft 3, spur gear 9, large gear 10 and the clutch not shown. The overrunning clutch 7 prevents the reverse motion of the kick lever 18, etc.

The cranking mechanism including the self-starting motor 13 enables the electrical starting of the engine as will hereinafter be described. The self-starting switch 14 is closed to supply electric current from the battery 15 to the self-starting motor 13 and thereby cause it to rotate. The rotation of the output shaft 13*a* is transmitted to the crankshaft 1 through the pinion 16, intermediate gear 11, overrunning clutch 7, sprocket 5, chain 6 and sprocket 2, whereby the engine is started. The unidirectional engagement of the clutch portion 17*a* prevents the reverse rotation of the kick lever 18 and the lever shaft 17. The rotation of the engine is transmitted to the speed change gear as hereinabove described.

The kick lever 18 and the lever shaft 17 have, however, their own structural limitations which disable them to rotate beyond a certain angle to cause the crankshaft 1 to rotate continuously. An internal combustion engine having a large displacement capacity is particularly difficult to start by the cranking mechanism including the kick lever 18. The cranking mechanism including the kick lever 18 and the cranking mechanism including the self-starting motor 13 are, therefore, both provided for some internal combustion engines of large displacement capacity for two-wheeled motor vehicles, as shown in FIG. 1. A high torque is required for causing the crankshaft 1 to rotate, especially when starting its rotation. The battery 15 in a two-wheeled motor vehicle has a relatively small capacity due to a limited space available for its installation. It is rapidly consumed, since it is freuquently used to start the engine. A reduction in the voltage supplied from the battery makes it more difficult to start the engine quickly.

DISCLOSURE OF THE INVENTION

It is an object of this invention to improve the drawbacks of the conventional apparatus as hereinabove pointed out and provide an internal combustion engine starter having a high starting performance obtained by first causing the second cranking mechanism to rotate the crankshaft mechanically and then causing the first cranking mechanism including a self-starting motor to place the crankshaft in continuous rotation.

According to this invention, the crankshaft is mechanically rotated by the second cranking mechanism during the beginning of its rotation which requires a high torque, and is subsequently placed in continuous rotation by the first cranking mechanism including the self-starting motor. It has only a reasonable amount of battery consumption and can be used to start the engine easily even after a reduction in the voltage supplied from the battery. It is, therefore, an apparatus of greatly improved starting performance and reliability.

BEST MODE OF CARRYING OUT THE INVENTION

Figure 1:
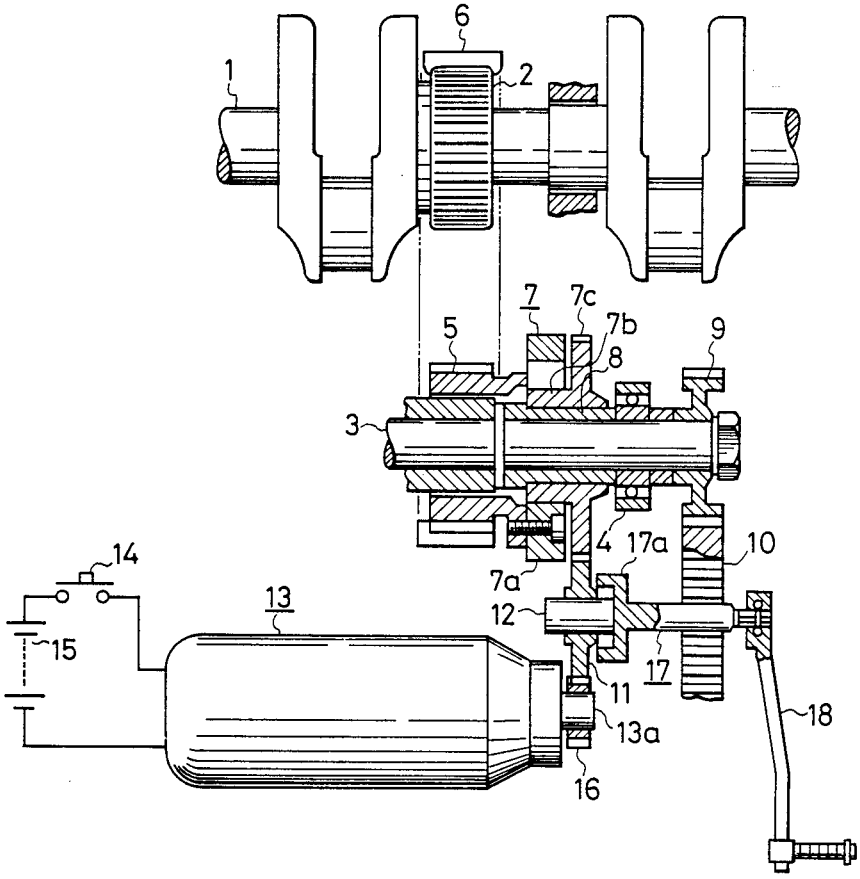
FIG. 1 is a side elevational view, partly in section, of a conventional apparatus.
Figure 2:
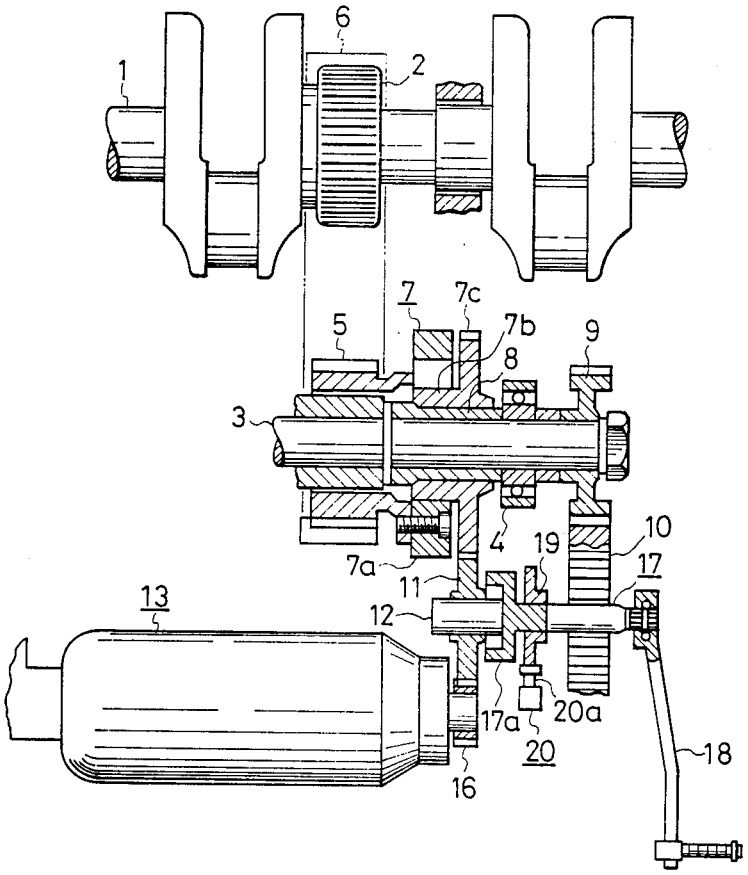
FIG. 2 is a side elevational view, partly in section, of an apparatus embodying this invention.
Figure 3:
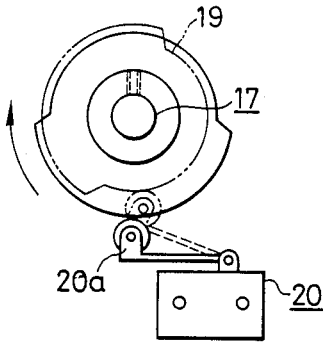
FIG. 3 is a front elevational view of the cam 19 and microswitch 20 shown in FIG. 2.
Figure 4:
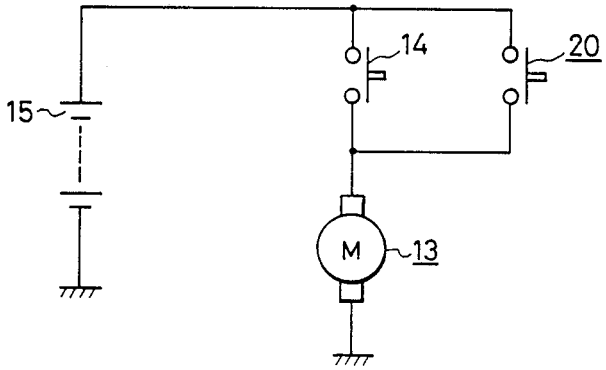
FIG. 4 is a circuit diagram for the apparatus of this invention.

An apparatus embodying this invention is shown in FIGS. 2 to 4. Like numerals are used to indicate like parts throughout FIG. 1 and FIGS. 2 to 4. Referring to FIGS. 2 to 4, a disk-shaped cam 19 is secured to the lever shaft 17 and a microswitch 20 having a lever 20*a* contacting the outer periphery of the cam 19 is connected in parallel to the self-starting switch 14. The cam 19 and the microswitch 20 define a means for driving the self-starting motor. The apparatus of this invention is identical to the conventional apparatus in all the other aspects of construction and no further description thereof will, therefore, be made.

In operation, the kick lever 18 is actuated to cause the cranking mechanism including the kick lever 18 to rotate the crankshaft 1 mechanically as hereinbefore described in connection with the conventional apparatus. At the same time, the cam 19 is rotated in the direction of an arrow to its position shown by a broken line in FIG. 3 to close the microswitch 20. An electric current is, therefore, supplied to the self-starting motor 13 to actuate the cranking mechanism including the motor 13 so that the crankshaft 1 which has been urged to rotate by the actuation of the kick lever 18 is placed in continuous rotation, whereby the engine is started. As the self-starting motor 13 is operated during the rotation of the crankshaft 1 by the kick lever 18, a relatively low torque is sufficient to place the crankshaft 1 in continuous rotation and does not cause any large consumption of the battery 15. After the engine has been started, the kick lever 18 is released from pressure, and a return spring not shown brings it back to its original position and thereby returns the cam 19 to its position shown by a solid line in FIG. 3, whereby the microswitch 20 is opened to discontinue the operation of the self-starting motor 13. It is also possible to actuate only the cranking mechanism including the self-starting motor 13 by closing the self-starting switch 14.

Figure 5:
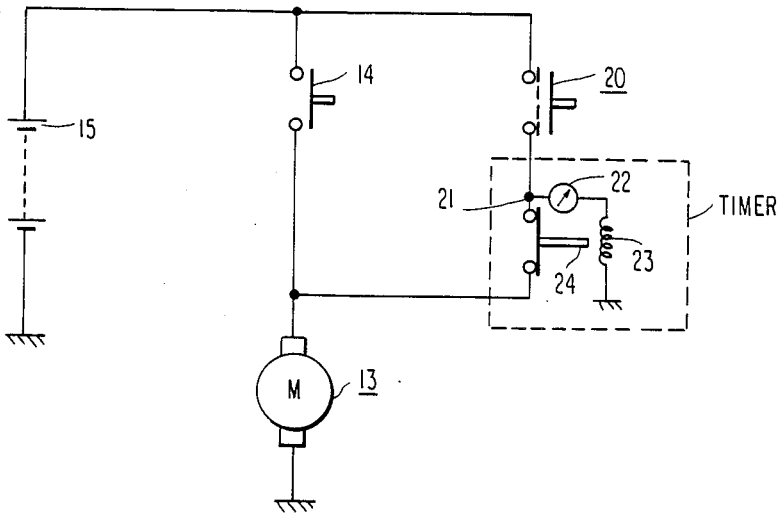
FIG. 5 is a circuit diagram for an alternate embodiment of the present invention.

Although the self-starting motor driving means hereinabove described comprises the cam 19 and the microswitch 20, it is equally possible to employ a means of different construction comprising, for example, a microswitch for detecting the rotation of the kick lever 18 and a timer responsive to its output for supplying an electric current to the self-starting motor 13 for a predetermined length of time. FIG. 5 shows schematically a modified circuit diagram from that of FIG. 4 in which like elements have like numerical designations and wherein the contactor 20 is closed to apply a voltage from source 15 for predetermined period of time as defined by countdown of counter 22 which is well known per se and which controls the flow of current to coil 23 for opening the normally closed contacts of contactor 24. As a result electric current flow to the starter motor 13 is terminated.

It is also possible to provide a path for electric current to the self-starting motor 13 with a motor protecting device which opens its contacts upon detecting the start of the engine. This arrangement is effective for improving the reliability of the apparatus to a further extent.

Although the foregoing description has been based on the internal combustion engine of a two-wheeled motor vehicle provided with the cranking mechanism including the kick lever 18 and the cranking mechanism including the self-starting motor 13, this invention is, of course, applicable to an internal combustion engine of any other type, too, for example, one for an outboard which is provided with a cracking mechanism including a recoil starter and a cranking mechanism including a self-starting motor.

Although the first and second cracking mechanisms have been described as sharing certain mechanical connecting parts from the sprockets 2 and 5 to the rotary shaft 12 for the intermediate gear 11, it is, of course, possible to construct those two mechanisms completely independently of each other.

INDUSTRIAL UTILITY

This invention is applicable not only to a starter for the internal combustion engine of a two-wheeled motor vehicle or an outboard, but also to a starter for an internal combustion engine of any other type.

I claim:

1. A starter for an internal combustion engine comprising a first cranking mechanism including a self-starting motor for causing an engine crankshaft to rotate electrically, a second mechanical cranking mechanism for causing said crankshaft to rotate mechanically and means for detecting the operation of said second mechanical cranking mechanism for a predetermined time to effect initial rotation of said crankshaft to a predetermined extent for delayed energizing said self-starting motor, so that said motor may place said crankshaft in continuous rotation only after said second cranking mechanism has caused it to initially rotate.

2. A starter for an internal combustion engine comprising a first cranking mechanism including a self-starting motor for causing an engine crank shaft to rotate electrically, a second mechanical cranking mechanism for causing said crank shaft to rotate mechanically and means for detecting the operation of said second mechanical cranking mechanism for a predetermined time to effect initial rotation of the crank shaft to a predetermined extent for delayed energizing said self-starting motor so that the motor may place said crank shaft in continuous rotation only after the second cranking mechanism has caused it to initially rotate, and wherein said second mechanical mechanism comprises a kick lever, said first cranking mechanism comprises a cam secured to said kick lever and a microswitch controlling electric current flow to said self-starting motor having a lever contacting the outer periphery of said cam.

3. A starter for an internal combustion engine as set forth in claim 1, wherein said second mechanical cranking mechanism comprises a kick lever, said first cranking mechanism comprises a microswitch controlling electric current flow to said self-starting motor for detecting the rotation of said kick lever and a time responsive to the closure of said microswitch for supplying an electric current to said self-starting motor for a predetermined length of time.

4. A starter for an internal combustion engine as set forth in claim 1, wherein said second cranking mechanism includes a recoil starter.

* * * * *